US007320653B2

(12) United States Patent
Fitzgerald et al.

(10) Patent No.: US 7,320,653 B2
(45) Date of Patent: Jan. 22, 2008

(54) TUBULAR BASEBALL BATS WITH FULL LENGTH CORE SHAFTS

(75) Inventors: Stephen Fitzgerald, Ottawa (CA); Frederic St. Laurent, Val des Monts (CA); Terrance William Sutherland, Ottawa (CA)

(73) Assignee: CE Composites Baseball Inc.

( * ) Notice: Subject to any disclaimer, the term of this patent is extended or adjusted under 35 U.S.C. 154(b) by 0 days.

(21) Appl. No.: 11/380,038

(22) Filed: Apr. 25, 2006

(65) Prior Publication Data

US 2006/0258490 A1 Nov. 16, 2006

Related U.S. Application Data

(62) Division of application No. 10/816,208, filed on Apr. 2, 2004, now Pat. No. 7,044,871.

(51) Int. Cl.
*A63B 59/06* (2006.01)

(52) U.S. Cl. ..... 473/566; 473/567

(58) Field of Classification Search ..... 473/457, 473/519, 520, 564–568
See application file for complete search history.

(56) References Cited

U.S. PATENT DOCUMENTS

| | | | | | |
|---|---|---|---|---|---|
| 3,877,698 | A | * | 4/1975 | Volpe | 473/520 |
| 4,951,948 | A | * | 8/1990 | Peng | 473/520 |
| 5,150,897 | A | * | 9/1992 | Wortman | 473/567 |
| 5,219,164 | A | * | 6/1993 | Peng | 473/520 |
| 5,364,095 | A | | 11/1994 | Easton et al. | |
| 5,393,055 | A | * | 2/1995 | McKay, Jr. | 473/566 |
| 5,415,398 | A | | 5/1995 | Eggiman et al. | |
| 5,593,158 | A | | 1/1997 | Fillice et al. | |
| D399,545 | S | | 10/1998 | Albarelli, Jr. | |
| 6,007,439 | A | * | 12/1999 | MacKay, Jr. | 473/520 |
| 6,042,493 | A | | 3/2000 | Chauvin et al. | |
| 6,053,828 | A | | 4/2000 | Pitsenberger | |
| 6,099,422 | A | * | 8/2000 | Rappaport et al. | 473/567 |
| 6,251,034 | B1 | | 6/2001 | Eggiman et al. | |
| 6,425,836 | B1 | | 7/2002 | Misono et al. | |
| 6,440,017 | B1 | | 8/2002 | Anderson | |
| 6,461,260 | B1 | | 10/2002 | Higginbotham | |
| 6,482,114 | B1 | | 11/2002 | Eggiman et al. | |
| 6,540,627 | B1 | * | 4/2003 | Leal et al. | 473/564 |
| 6,612,945 | B1 | | 9/2003 | Anderson | |
| 7,044,871 | B2 | | 5/2006 | Sutherland et al. | |
| 2002/0094892 | A1 | | 7/2002 | Chauvin et al. | |

* cited by examiner

*Primary Examiner*—Mark S Graham
(74) *Attorney, Agent, or Firm*—David J. French

(57) ABSTRACT

A tubular baseball bat comprising a substantially full length core shaft of preferably constant cross-section, including a handle portion, and a barrel with a gap or separation between the core shaft and barrel, the core shaft and barrel being connected at two or more locations. Embodiments include bats with long barrels without taper sections, bats with taper sections integral with the barrels, bats with separate taper sections which may be of non-circular cross-section, bats with flexible circumferential connecting structures, bats with folded barrel end portions, and bats with resilient means between the core shaft and barrel. Such bats can have larger hitting areas, larger sweetspots, higher performance, and provide minimal sting to a player's hands.

5 Claims, 14 Drawing Sheets

TUBULAR BASEBALL BATS WITH FULL LENGTH CORE SHAFTS

This application is a divisional of U.S. patent application Ser. No. 10/816,208 filed Apr. 2, 2004 now U.S. Pat. No. 7,044,871.

FIELD OF THE INVENTION

The present invention relates to baseball bats and more particularly to tubular baseball bats, constructed of a variety of materials, and more particularly to baseball bats designed to improve player performance as defined by greater hitting distance, greater hitting surface, and bigger sweetspot, without unfavourable handle vibration or sting.

BACKGROUND OF THE INVENTION AND PRIOR ART

Baseball and softball bats, hereinafter referred to simply as "bats", are today typically made solely from aluminum alloys, or aluminum alloys in combination with composite materials (hybrid bats), or most recently solely from composite materials (with the exception of solid wooden bats for the Major Leagues). Such bats are tubular (hollow inside) in construction in order to meet the weight requirements of the end user, and have a cylindrical handle portion for gripping, a cylindrical barrel portion for striking, and a tapered mid-section connecting the handle and barrel portions.

When aluminum alloys initially replaced wooden bats in most bat categories, the original aluminum bats were formed as a single member, that is, they were made in a unitary manner as a single-walled aluminum tube for the handle, taper, and barrel portions. Such bats are often called single-wall aluminum bats and were known to improve performance relative to wooden bats as defined by increased hit distance. Such bats have constant stiffness along their barrel portion length.

All such prior art single wall bats, of any material, have cylindrical handle portions with diameters less than 1", cylindrical barrel portions with diameters greater than 2", both portions continuous with a cylindrical taper portion increasing in diameter from the handle portion to the barrel portion.

U.S. Pat. No. 5,303,917 to Uke discloses a tubular bat with a handle portion and a barrel portion shaped at their innermost ends to telescope and overlap together along a single area of contact. Both portions are not of uniform cross-section, do not extend the full length of the bat, and are not isolated from each other.

More recently (in the mid 1990's), improvements in bat design largely concentrated on further improving bat performance. This was accomplished primarily by thinning the barrel or hitting portion of the bat frame and adding inner or internal, and/or outer or external, secondary members extending along the entire barrel length. These members are often referred to respectively as inserts or sleeves; while the main member is often referred to as a body, shell or frame in the prior art. Such bats are often called double-wall bats or multi-walled bats in the case of more than two walls.

The prior art of such double walled and multi-walled tubular bats generally refers to improved performance or hit distance resulting from trampoline effect, spring, compliance, rebound, flexibility, etc. resulting from the multi-wall two or more member construction along the entire barrel length allowing the barrel portion of the bat to deflect or flex more upon ball impact which propels the ball faster and further than prior art bats.

All such prior art tubular bats have a sweetspot, generally two or four inches in length, located centrally along the barrel portion length. The sweetspot is the barrel portion length of maximum bat performance as defined by batted ball distance. As the batted ball location moves away from the sweetspot area towards either the barrel extreme end or the taper end, bat performance progressively decreases.

U.S. Pat. No. 5,364,095 to Easton discloses a double-wall bat consisting of an external metal tube and an internal composite sleeve bonded to the inside of the external metal tube and running full length of the barrel portion of the bat. Further, U.S. Pat. No. 6,042,493 to Chauvin, et al. discloses a double-wall bat with an insert made of titanium and composite materials.

U.S. Pat. No. 5,415,398 to Eggiman discloses a double-wall metallic bat consisting of a frame and internal insert of constant thickness running full length of the barrel portion of the bat in a double-wall construction. Further, U.S. Pat. Nos. 6,251,034B1 and 6,482,114B1 disclose variations to U.S. Pat. No. 5,415,398. Further, U.S. Pat. No. 6,251,034B1 discloses a polymer composite second tubular member running full length of the barrel portion of the bat with the barrel members joined at the ends only of the barrel portion with the balance of the composite member freely movable relative to the primary member. U.S. Pat. Nos. 6,440,017B1 and 6,612,945 B1 to Anderson also disclose double-wall bats with an outer sleeve and inner shell of constant thickness running full length of the barrel portion.

U.S. Pat. No. 6,053,828 to Pitsenberger discloses a double-wall bat consisting on an internal body and an external shell of constant thickness running full length of the barrel portion in a double-wall construction. U.S. Pat. No. 6,461,260B1 to Higginbotham discloses the bat of U.S. Pat. No. 6,053,828 with a composite shell formed to an outer shell running full length of the barrel portion of the bat.

Similarly, U.S. Pat. No. 6,425,836B1 to Misono discloses a double-wall bat with a lubricated coating between layers or a weak boundary layer formed on the surfaces of the inner member.

US Patent Pub. 2001/0094892 A1 by Chauvin discloses a double-wall bat consisting of an outer shell and an insert laminate partially bonded to the shell.

In all prior art multi-walled tubular bats, the primary bat frame member and secondary barrel member(s) extend along the entire barrel length and are of constant thickness. Also, the bat members in the barrel portion are not joined, except at their ends, in order to reduce radial stiffness of the barrel portion to improve bat performance. This provides a trampoline effect which is greatest in the central barrel area called the sweetspot. Increasing the barrel portion, or hitting area, increases the sweetspot size similarly to increasing the hitting areas of tennis racquets and golfclubs.

All such prior art double wall bats, of any material, have cylindrical handle portions and cylindrical barrel portions. Both portions being continuous with a cylindrical taper portion increasing in diameter from the handle portion to the barrel portion. It is well known that hits in the sweetspot area do not produce unpleasant sting in the batter's hands while hits away from the sweetspot area, particularly close to either extreme barrel portion ends, results in unpleasant sting in the batter's hands.

The sting in the batter's hand is due to rapid vibration movement of the handle portion generated by the violent and high free impact of the ball and the bat barrel portion away from the sweetspot area. The vibration energy of the ball impact travels from the barrel, through the taper, to the joined handle portion of prior art bats. In an attempt to reduce sting, cushioned grips, and padded gloves, special endcaps, foam interiors and other such means are well known at best to provide minimum relief.

U.S. Pat. No. 5,593,158 to Filice discloses a tubular bat with a handle portion and a barrel portion shaped to overlap along a single area of contact in the taper region and separated by thin elastomeric material to attenuate vibrations. Both bat portions are not of uniform cross-section and do not extend full length of the bat. Such bats only provide minimal relief from sting due to such elastomeric material being highly rate, or time, dependant; that is, the extremely rapid vibrational bat movements, are minimally attenuated.

In summary, prior art bats have hitting area sizes (i.e. barrel portion lengths) limited by materials employed, traditional bat geometries and desired finished weights. Further, prior art bats have limited length sweetspot areas of highest bat performance and traditional geometries such that off sweetspot hits cause vibrations resulting in unfavourable sting in hitter's hands. All such prior art bats have traditional circular tubular handles that are considerably shorter than the full bat length and/or have a non-uniform cross-sectional area along the taper portion length; and whose barrel and handle portions are in contact at one distinct locational area only; and thus whose barrel and handle portion perform dependently with each other.

Therefore, what is needed are tubular bats with larger hitting areas in order to allow batters to increase the percentage of hitting area ball contacts to in turn increase batting average, a fundamental measure of player performance. It is also well known that by increasing the hitting area, the sweetspot increases in size and the trampoline effect increases, thereby improving performance as defined by hit distance. Further, what is needed are tubular bats with larger sweetspot areas, ideally full length of the hitting area barrel portion, which increases the area of maximum bat performance. Also, larger sweetspot areas decrease the number of off sweetspot ball contacts which cause unfavourable sting in the batters hands. Further, what is needed is tubular bats which minimize sting, and ideally eliminate sting, due to off sweetspot ball contacts.

SUMMARY OF THE INVENTION

To achieve the benefits of the present invention, preferred bat embodiments comprise of a central core shaft, a barrel for hitting, and at least two connecting structures between the core shaft and the barrel. The core shaft, preferably of constant cross-sectional area, includes a handle portion and generally, but not necessarily, extends substantially full length of the bat. Without a prior art taper section, bats of the present invention can have barrel lengths up to as long as the combined lengths of the barrel and taper portions of prior art bats.

Further, bats of the present invention include embodiments which have two or more, preferably flexible or resilient, circumferential connecting structures between the full length central core shaft and separate barrel. Thus, the barrel being largely isolated from the shaft acts more independently of the shaft. Upon contact with the ball, the barrel flexes more uniformly along its length thus creating a sweetspot which extends substantially for a fuller length of the barrel.

To substantially minimize or eliminate unfavourable sting in the hitter's hands due to off sweetspot hits, embodiments of the bats of the present invention may include two or more circumferential connecting structures between the full length core shaft and separate barrel which are flexible or resilient. With the barrel and handle portion of the core shaft being essentially isolated from each other, vibrations originating in the barrel due to ball contact are less likely to be transmitted to the handle portion at the shaft proximal end, and thus to players hands, thereby essentially eliminating or minimizing sting. Also, by the barrel and core shaft being both more nearly independent and separate, the stiffness of the shaft can be increased independently of the barrel, thus also reducing vibrations in the handle portion of the core shaft.

Further, other embodiments of the present invention include a separate, added taper section which can be circular, or preferably non-circular, such as star shaped, to further damp any vibrations generated in the barrel before being transmitted to the handle portion of the core shaft thereby minimizing sting.

Another embodiment of the present invention consists of a barrel with folded ends in contact with at least two distinct locational areas on the shaft which extend substantially for the length of the bat.

Another embodiment of the present invention includes a plurality of flexible circumferential connecting structures between the core shaft and barrel with stiffnesses selected to improve both bat performance and sweetspot size. These connecting structures may be a resilient means, such as, springs or disc-like rings disposed between the barrel and core shaft to improve bat performance and sweetspot size.

Another embodiment of the present invention includes light weight foam as a resilient means between the barrel and core shaft with or without flexible circumferential connecting structures.

Another embodiment of the present invention includes a singular airbag or a plurality of airbags as a resilient means between the barrel and core shaft In another embodiment of the present invention the resilient means provides the actual batting surface of the bat.

All embodiments of the present invention include a traditional knob, circular or non-circular core shafts, variable geometry connecting or resilient structures, and may include, optional separate endcaps, optional endcaps incorporated into a connecting structure, and optional taper sections.

BRIEF DESCRIPTION OF THE DRAWINGS

The present invention will now be described with reference to the accompanying drawings, in which:

FIG. 6 shows the taper, the core shaft, and the barrel being three separate bat components.

DETAILED DESCRIPTION OF THE INVENTION

Figure 1:
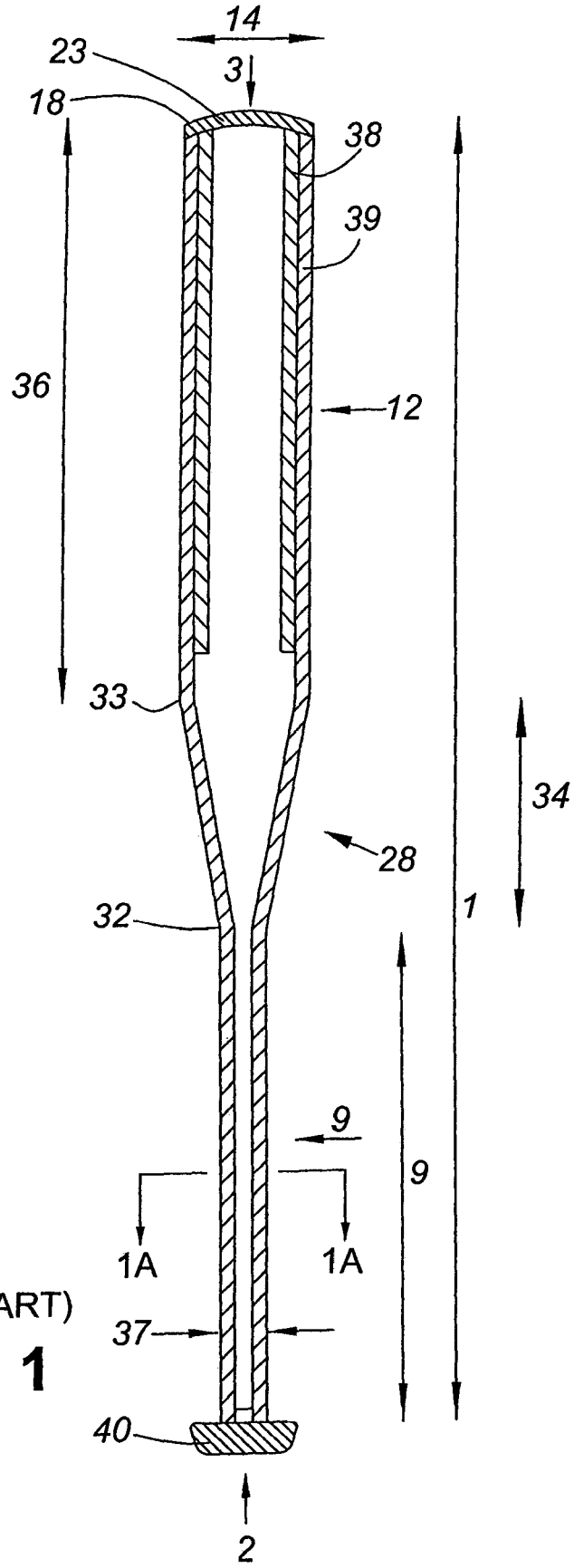
(PRIOR ART) FIG. 1
FIG. 1 shows a longitudinal cross-section and geometry of a typical prior art tubular double wall bat with separate barrel members with a taper portion joining a smaller diameter handle portion such that the barrel member and handle member act dependently of each through a single area of contact through the taper portion.
Figure 1A:
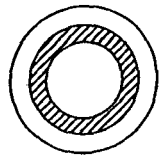
FIG. 1A shows a typical prior art circular cross-section handle portion.

Prior art tubular bats shown in FIG. 1 have a bat length 1, barrel portion 12, prior art barrel length 36, barrel diameter 14; a continuous taper portion 28 of circular cross-section increasing from the taper portion proximal end 32 to distal end 33; and a continuous handle portion 9 with handle length 9 and handle diameter 37. Also shown is a typical endcap 23 and knob 40. Barrel diameter 14 is 2¼ inches for softball and youth baseball, and 2⅝ inches for adult baseball. Handle diameter 37 is less than 1 inches for all baseball categories and has a circular cross-section. The handle portion 9 connects with the barrel portion 12 at one distinct location area through the circular continuous taper portion 27. FIG. 1 further shows a typical double wall prior art tubular bat with internal insert 38, continuous frame 39, and separate endcap 23 closing off the barrel portion distal end 18. A typical knob 40 closes off the bat proximal end 2.

All bat embodiments of the present invention as shown in FIGS. 2 through 13 include a core shaft 4 with a length 5 substantially that of the overall bat length 1. This shaft may, however, extend for less than the full length of the bat. Most such bats have a separate barrel 12 which contacts the shaft 4 at two or more distinct contact locations. The bat has a proximal end 2 and a distal end 3. The shaft has a proximal end 10, a distal end 11 with a handle portion 9 starting at the shaft proximal end 10, and a shaft cross-section 8 (circular or otherwise) which is preferably, but not necessarily, constant over the shaft length 5. The barrel 12 has a length 13 or 36, a diameter 14, a proximal portion 15 with a proximal end 17 and a distal portion 16 with a distal end 18. Most embodiments (FIGS. 2 through 9) have a gap between the core shaft 4 and the barrel 12 which occupies the separation 22 between the core shaft 4 and barrel 12. The handle portion 9 may have a cross-section which is circular FIG. 2A, ovoid FIG. 2B, elliptical FIG. 2C, or triangular FIG. 2D as well as other forms.

The present invention is directed in one variant to providing tubular baseball bats with larger hitting areas; that is, longer barrel lengths 13 to improve a player's batting average. The long barrel length 13 embodiments of the present invention (for example, FIGS. 2, and 5 through 11) could have long barrel lengths 13 as long as the combined prior art barrel length 36 and prior art taper length 34. For example, a present invention adult bat with a long barrel length 13 of 12 inches, can have a hitting area increased by 50% over prior art adult bats. With such a larger hitting area 13, everything else being equal, it is reasonable to assume that a player will improve their batting average over the course of a season with long barrel length 13 bat embodiments of the present invention. For example, if a player using a long barrel length 13 bat of the present invention, made only one more hit every thirty-two times at bat, they would increase their average from 285 to 313. Such an increase for a college level player would make the difference from playing, or not playing, in the Major Leagues.

Figure 2:
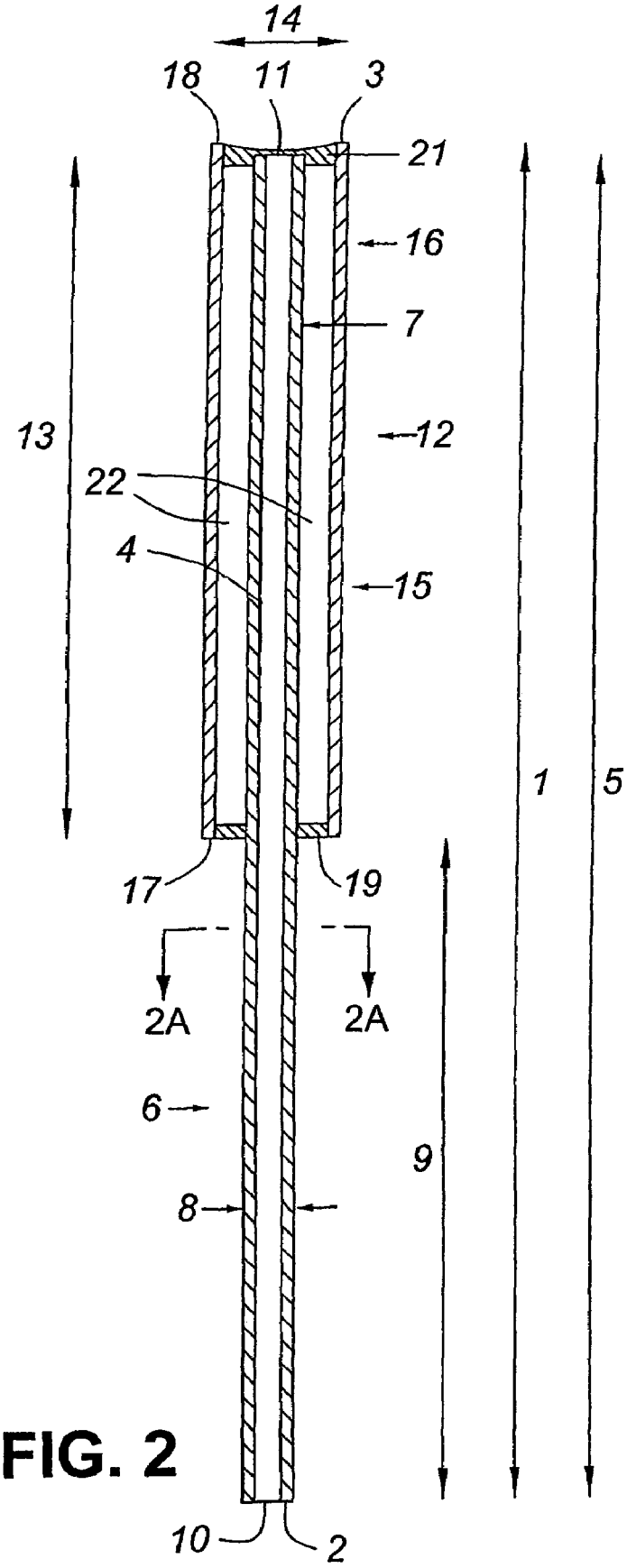
FIG. 2 shows a longitudinal cross-section of one embodiment of the present invention with a long barrel and in accordance with one variant of the present invention a core shaft of constant cross-sectional shape and area which extends substantially the full length of the bat and is in contact with the barrel at two distinct locational areas through two connecting structures one of which serves as an endcap.
Figure 2A:
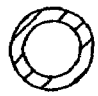
FIG. 2A shows a circular cross-section of the core shaft handle portion of FIG. 2.
Figure 2B:
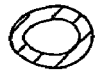
FIG. 2B shows an alternate ovoid cross-section of the core shaft handle portion.
Figure 2C:
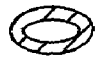
FIG. 2C shows an elliptical cross-section of the core shaft handle portion.
Figure 2D:
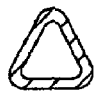
FIG. 2D shows a triangular cross-section of the core shaft handle portion.
Figure 3:
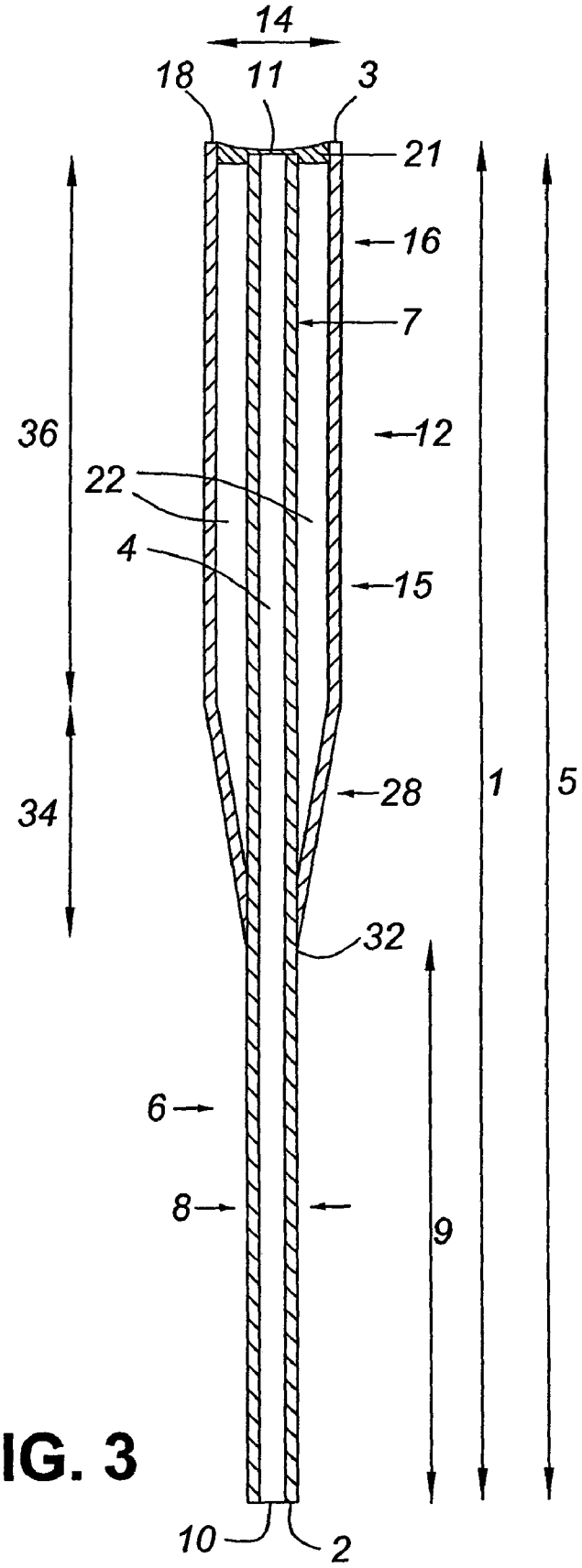
FIG. 3 shows a longitudinal cross-section of another embodiment of the present invention which has a taper section integral with the barrel serving as a circumferential connecting structure.
Figure 9:
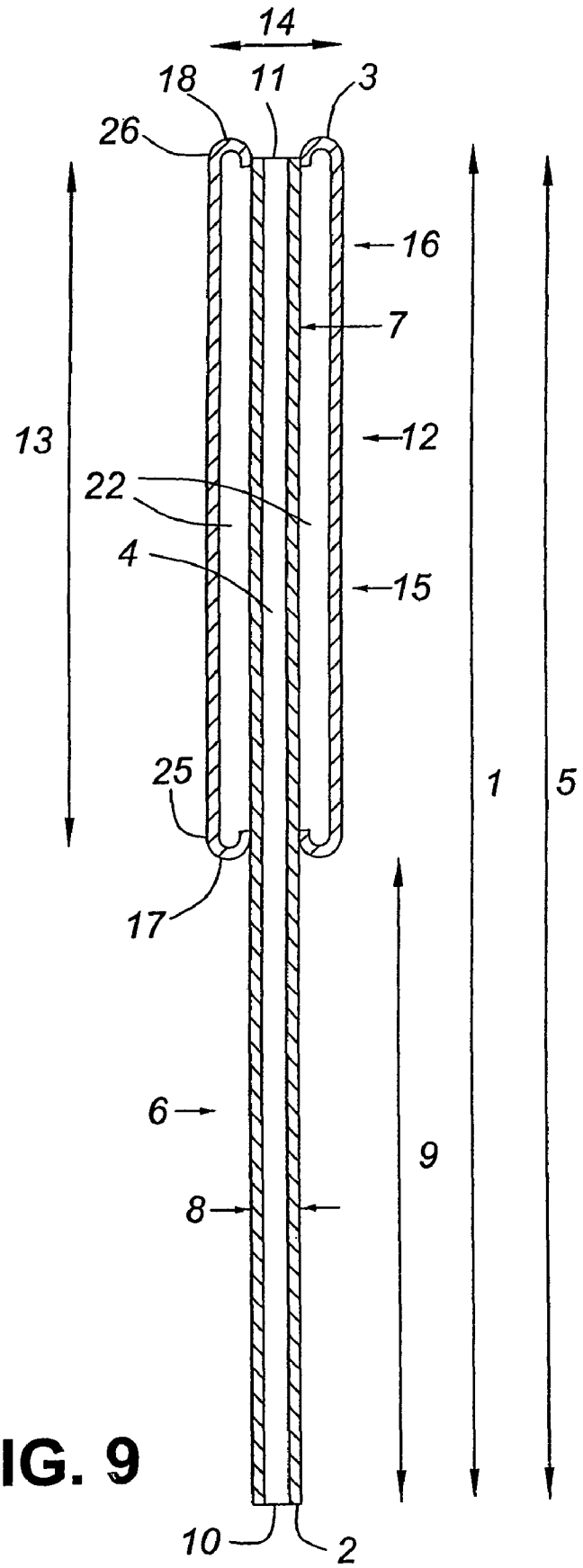
FIG. 9 shows a longitudinal cross-section of another embodiment of the present invention with a core shaft and a barrel having folded ends in contact with two distinct locational areas of the core shaft.

Further, the present invention is directed to providing tubular baseball bats with improved bat performance as defined by hit distance. This is accomplished by longer barrel length 13 bat embodiments of the present invention as shown in FIG. 2; and/or by flexible connecting structures 19 and/or 20 and/or 21 as shown in FIG. 2 through 8; or by a barrel 12 with folded proximal barrel section 25 and folded distal barrel section 26, as shown in FIG. 9; or by a resilient means such as, foam 35 shown in FIG. 10, rings 43 shown in FIGS. 11A and B, springs 42 shown in FIG. 12, or airbags 44 shown in FIG. 13.

The scientific principle governing improved bat performance is bending theory. When a ball impacts a bat it has kinetic energy that must be absorbed by the bat in order to stop the ball. The bat stores this energy by flexing. After the ball is stopped, the bat returns the energy it stored by rebounding and sending the ball back towards where it came from. The more the bat barrel 12 or striking portion deforms upon ball impact without failing (denting or breaking), the lower the energy loss in the ball, and the greater the energy return to the ball from the bat as the impacted tubular bat barrel 12 returns to its original shape. To allow the bat barrel 12 to deform requires lowering the radial stiffness of the barrel 12. The prior art double walled (FIG. 1) and multi-walled tubular bats accomplish this by thinning the main member continuous frame 39 and adding thin secondary member insert(s) 38 and/or sleeve(s) which are not joined, other than at their ends, to the main member 39, and which extend full length 36 of the barrel 12, and result in lowered constant radial stiffness along the barrel 12. However, the bending stiffness of the prior art tubular bat and barrel 12 radial stiffness cannot be independently optimized as the barrel 12 is joined to the handle portion 9 through the taper portion 27.

The ideal design principle objectives of a baseball bat are identical to that of a tennis racquet; that is, high longitudinal or bending stiffness in the handle to reduce bending mode vibrations which reduces sting in the player's hands, and low radial stiffness in the hitting portion to increase the trampoline effect which increases ball speed after hitting and thus, ball distance which determines bat performance.

Bats of the present invention having separate barrels 12 and separate core shafts 4, with handle portions 9 starting at the proximal shaft end 10, that act independently of each other. Thus, the core shaft 4 is ideally designed with relatively high longitudinal bending stiffness, and the barrel 12 is separately designed with relatively low radial stiffness. The improved barrel 12 radial stiffness achievable in bats of the present invention, over prior art bats, increases the trampoline effect which increases bat performance in bat embodiments of the present invention.

Also, the circumferential flexible connecting structures 19, 20, and 21 are designed to be flexible as a supplemental feature to further increase the trampoline effect and improve bat performance to that allowed by applicable regulating bodies. Decreasing radial stiffness of the circumferential flexible connecting structures 19, 20, and 21 can increase bat performance while increasing stiffness of the circumferential flexible connecting structures 19, 20 and 21 can decrease bat performance. In certain embodiments (FIGS. 2, 3, and 4), the endcap function may be provided by a disc-like flexible connecting structure 21. The circumferential flexible connecting structures 19, 20, and 21 of the present invention can be a variety of materials and geometrical cross-sections including, but not limited to, disk-like, circular, torus, conic, and pleated as shown in FIGS. 5 through 12.

A further embodiment of the present invention as shown in FIG. 9 has a barrel 12 with an integrally formed proximal folded end 17 and a similar distal folded end 18 which act similarly to the circumferential flexible connecting structures 19, 20, and 21 to increase bat performance.

Figure 10:
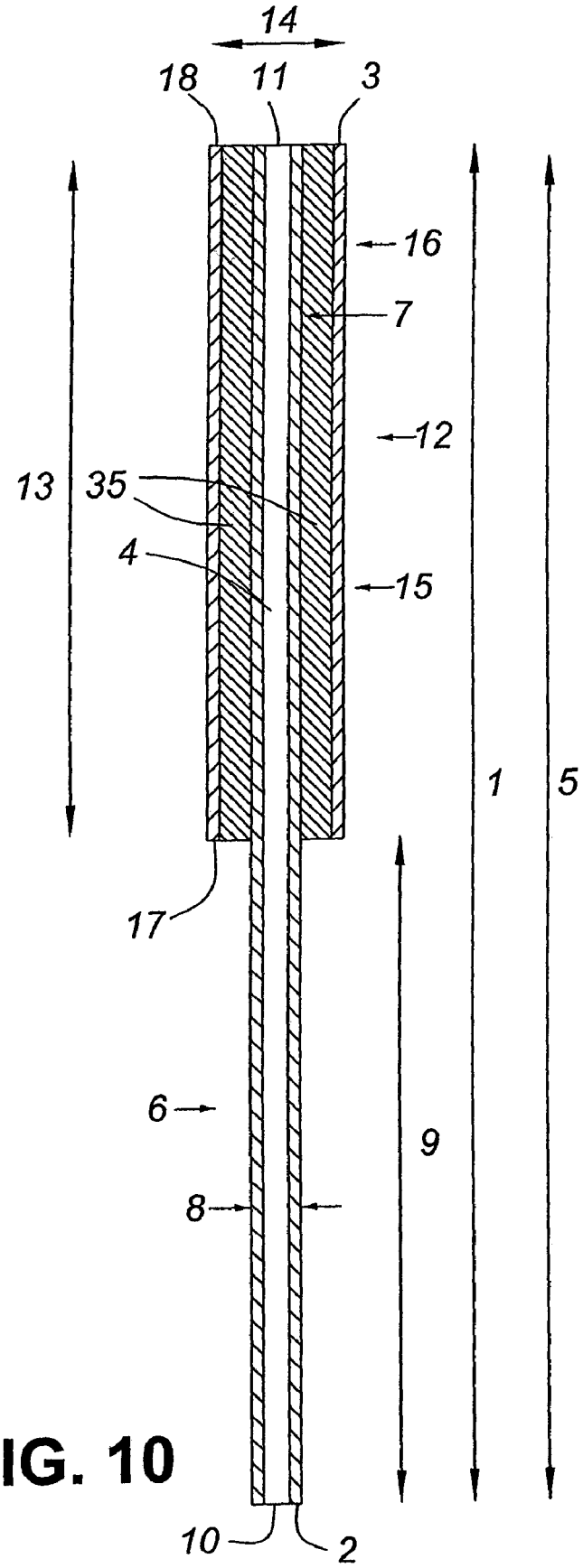
FIG. 10 shows a longitudinal cross-section of another embodiment of the present invention with foam between the barrel and shaft which provides continuous support between the barrel and core shaft. Though not shown, additional circumferential connecting structures may also be included in any of such foregoing embodiments. Also, though not shown, a plurality of foam circumferential connecting structures may be included in such embodiments.

A further embodiment of the present invention as shown in FIG. 10 has a resilient means in the form of a flexible foam material 35, disposed between the barrel 12 and the core shaft 4, with or without circumferential connecting structures 19, 20, and 21, which act similarly to the circumferential connecting structures 19, 20, and 21 to increase bat performance. The foam material 35 is typically selected from the group of linear, rigid, semi-rigid, flexible, resilient, closed cell, visco-elastic, materials or equivalent. The configuration of FIG. 10 provides distributed support for the barrel 12 along the barrel length 13 or 36. The foam material 35 allows the barrel 12 to elastically deform when the barrel 12 hits a ball and further, the foam material 35 attenuates sound and vibrations.

Figure 11A:
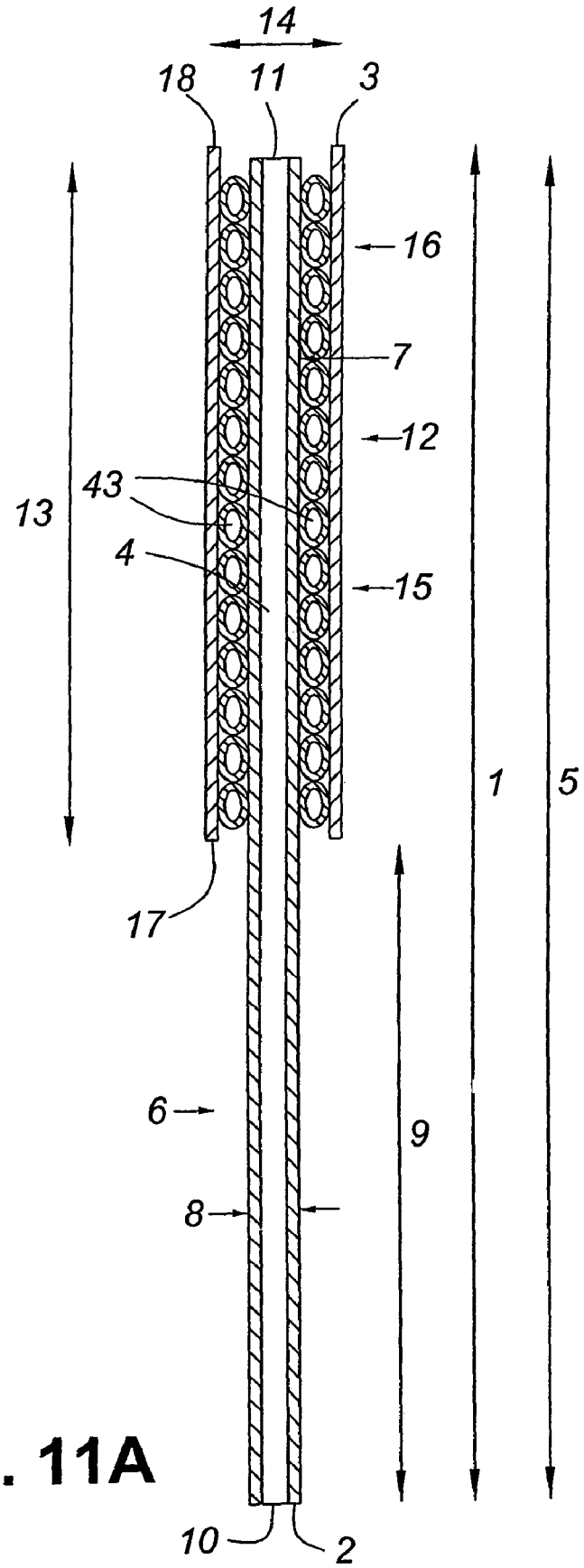
FIG. 11A shows a longitudinal cross-section of another embodiment of the present invention with a plurality of individual rings of toroidal or alternatively circular, cross-sectional geometry, between the barrel and core shaft which provide continuous support between the barrel and core shaft.
Figure 11B:
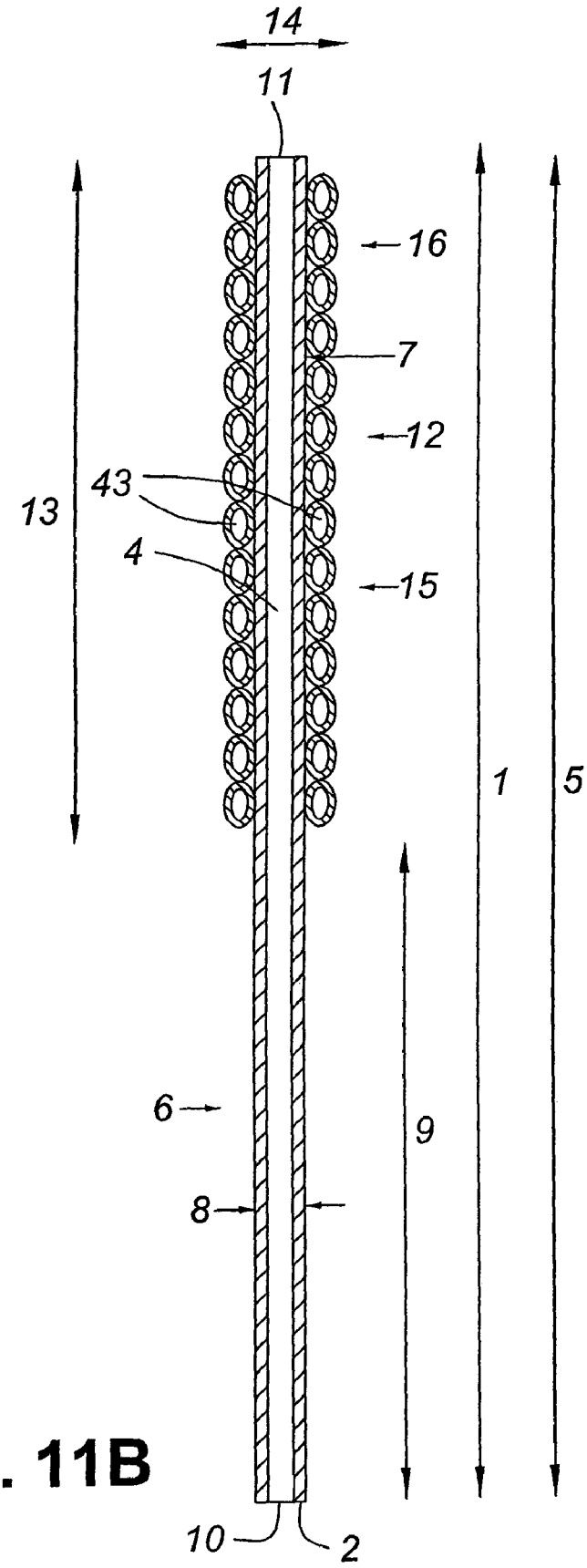
FIG. 11B shows the bat of FIG. 11A wherein the exposed plurality of rings provide the direct batting surface of the barrel.
Figure 12:
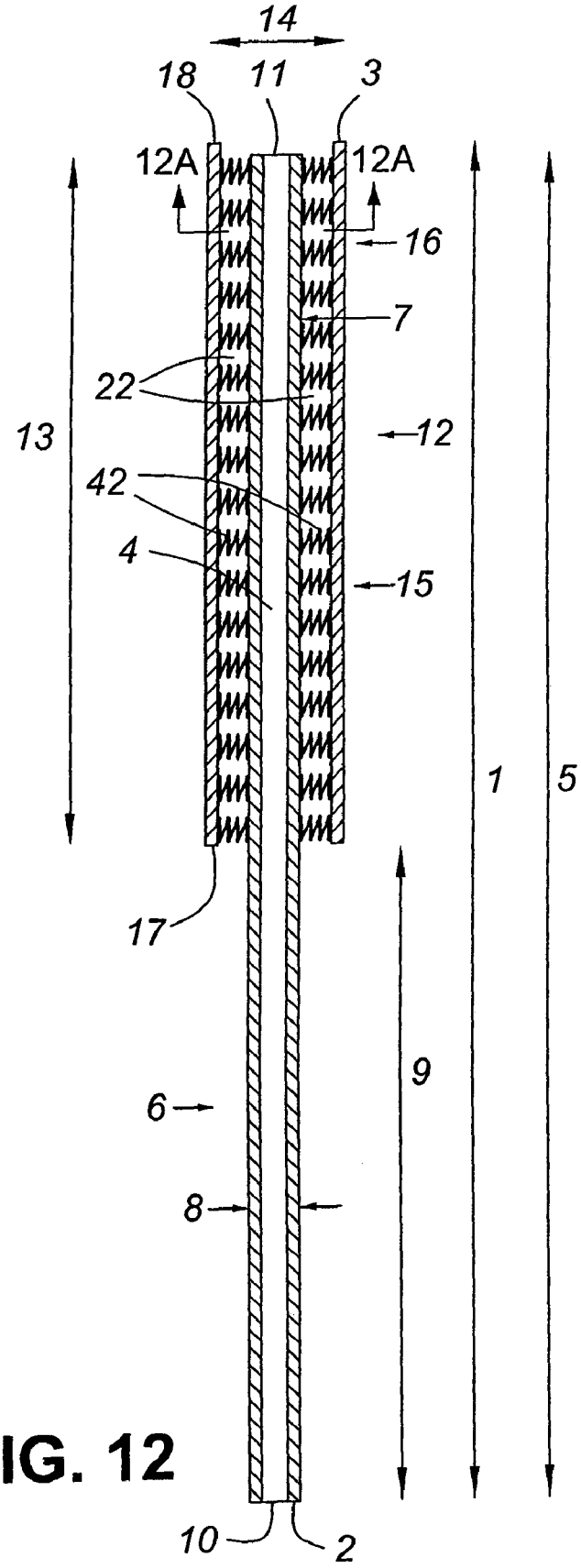
FIG. 12 shows a longitudinal cross-section of another embodiment of the present invention with springs between the barrel and core shaft which provide continuous support between the barrel and core shaft and allows the barrel to elastically deform.
Figure 12A:
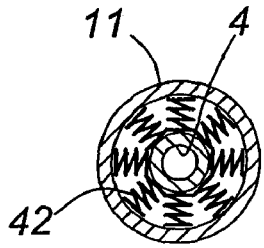
FIG. 12A shows a cross-sectional end views of the spring form of circumferential connecting structure.
Figure 13:
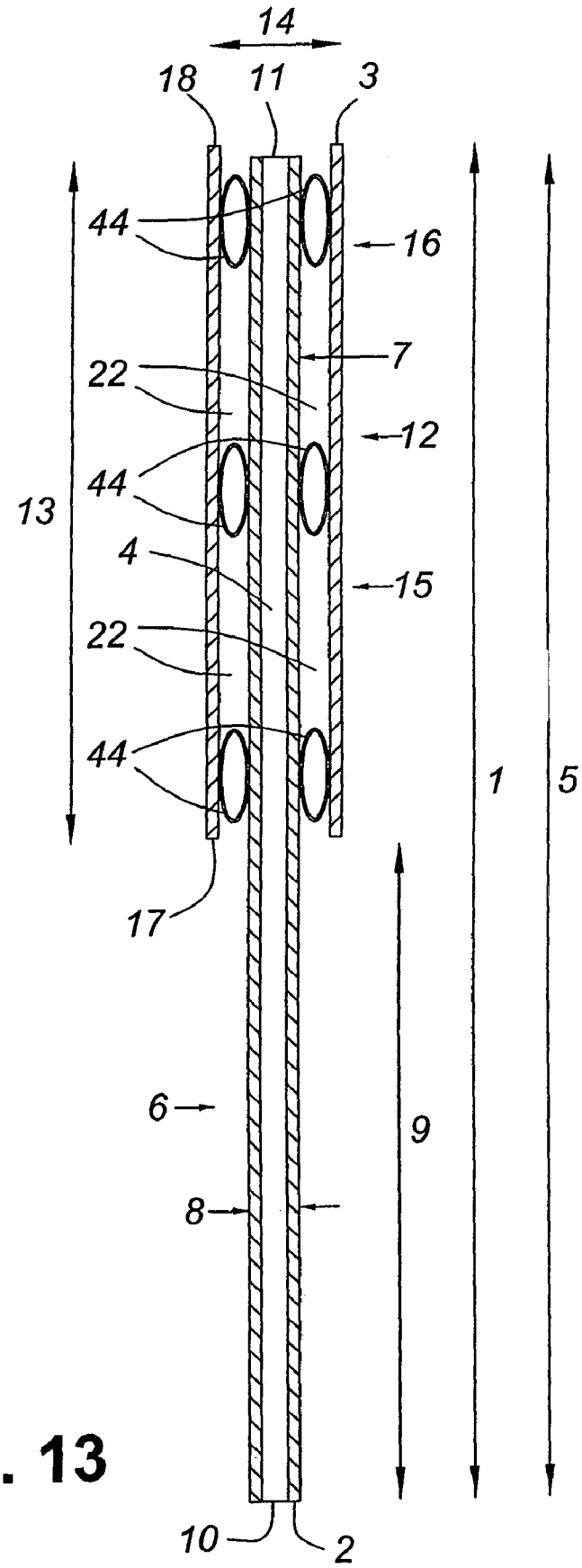
FIG. 13 shows a longitudinal cross-section of another embodiment of the present invention with a plurality of air bags between the barrel and core shaft. Though not shown, a singular airbag may be included as the connecting structure for such an air bag embodiment.

Further embodiments of the present invention, as shown in FIGS. 11A, 11B, 12, and 13 include a plurality of discrete flexible circumferential connecting structures which form a further resilient means disposed between the barrel 12 and the core shaft 4. As shown in FIG. 11A, the resilient means is in the form of multiple, individual torus-shaped rings 43 distributed along the core shaft 4 from the barrel proximal end 17 to the barrel distal end 18. Such connecting structures 43 allow the barrel 12 to elastically deform when the barrel 12 hits a ball. As shown in FIG. 11B, the connecting structures 43 can function to provide the ball hitting surface of the barrel 12 with an outer diameter equal to the barrel diameter 14. As shown in FIG. 12, the resilient means, may alternately be in the form of springs 42. As shown in FIG. 13, the resilient means may alternatively be in the form of a plurality of airbags 44. Though not shown in FIG. 13, a singular airbag could alternatively be employed, substantially filling the gap between the barrel and the core shaft. By having such a variety of discrete connecting structures 42, 43, and 44, each with varying radial stiffnesses, the sweetspot of the bat can extend more nearly to the full barrel length 13 or 36 by having the connecting structures 42, or 43 or 44 individual radial stiffnesses decrease proportionately from the sweetspot to both the barrel proximal end 17 and barrel distal end 18.

Figure 4:
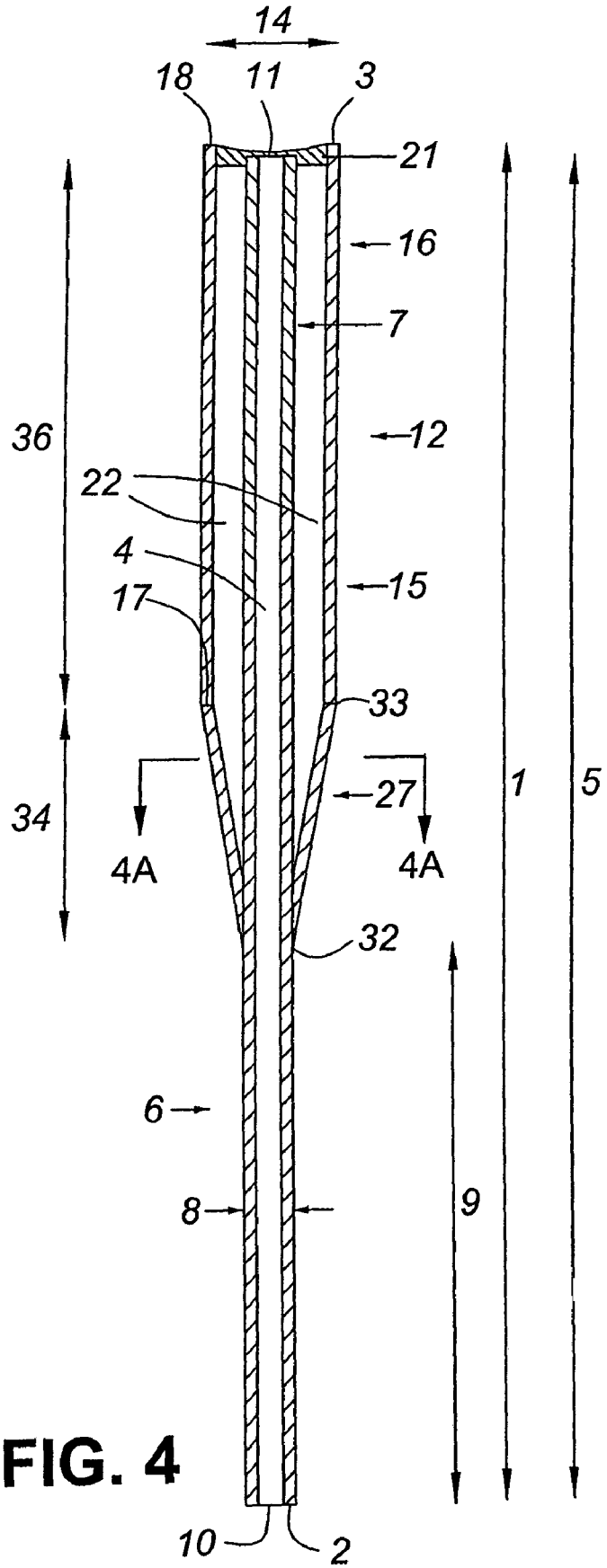
FIG. 4 shows a longitudinal cross-section of another embodiment of the present invention having a separate core shaft, and a separate barrel and which includes a separate additive taper section which may optionally be of non-circular cross-section, for example, star shaped.
Figure 4A:
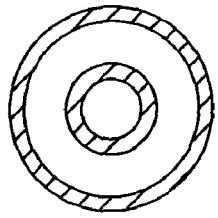
FIG. 4A shows a circular cross-section of the taper section of FIG. 4.
Figure 4B:
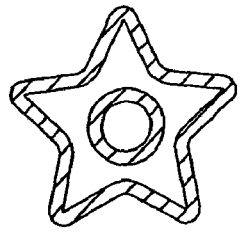
FIG. 4B shows an alternate star shaped cross-section for the taper section.
Figure 5:
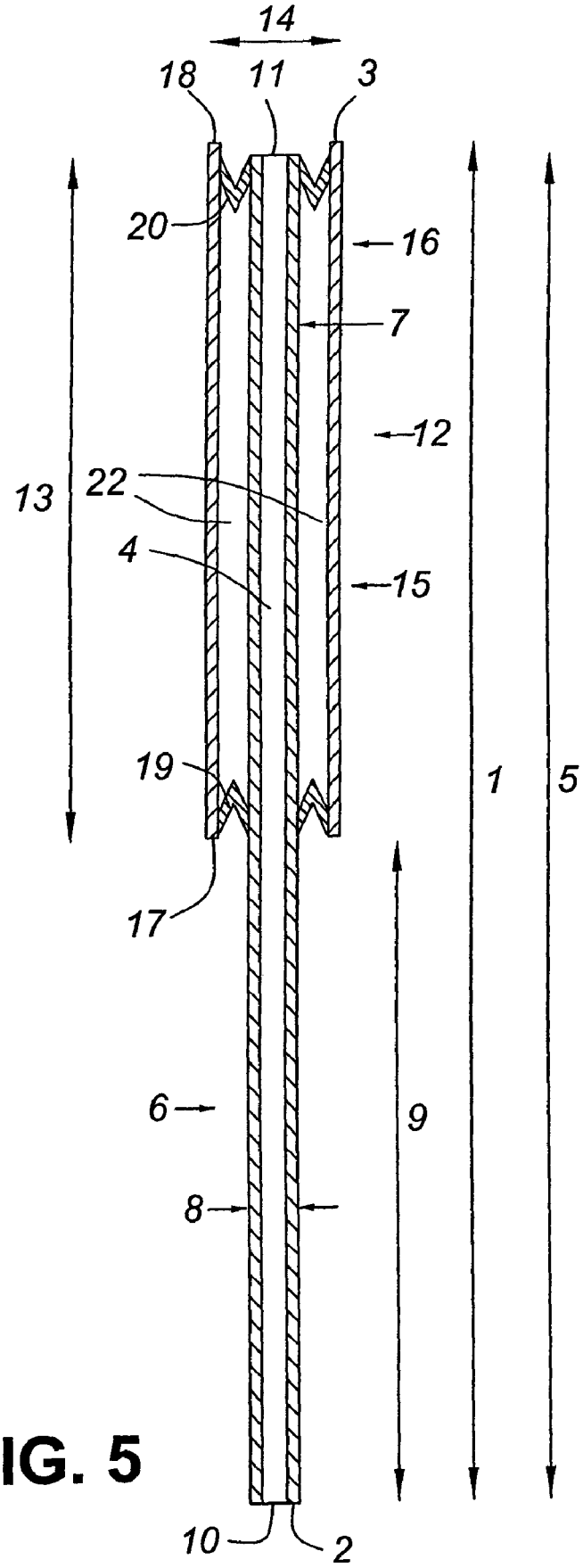
FIG. 5 shows a longitudinal cross-section of another embodiment of the present invention with two circumferential connecting structures, positioned between the core shaft and barrel, such structures being of pleated cross-sectional geometry.

Further, the present invention is directed to providing tubular baseball bats which substantially reduce, or eliminate, sting in the player's hands due to ball contacts away from the bat's sweetspot area which result in bending mode low frequency vibrations originating in the barrel 12. Such vibrations in bats of the prior art readily travel from the barrel 12 through the joined taper section 27 as shown in FIG. 1 to the joined handle portion 9, thus causing sting in the player's hands. Bat embodiments of the present invention, as shown in FIGS. 2 through 12, have a separate barrel 12 and a separate core shaft 4 which includes a handle portion 9. The barrel 12 and the core shaft 4 can be substantially isolated from each other by circumferential connecting structures 19, 20, and 21 of different materials, densities, stiffnesses, and geometries; or by a resilient means such as foam 35, springs 42, rings 43, or airbags 44; such that, vibrations generated in the barrel 12 are not readily transmitted to the core shaft 4, and are largely damped by the flexible connectors 19, 20, and 21 or resilient means 35, 42, 43, 44 resulting in minimal sting in the player's hands. Further, as the core shaft 4 is separate from the barrel 12, the core shaft 4 can be designed with maximum longitudinal stiffness (unlike prior art bats) which in itself reduces, or eliminates, low frequency bending vibrations which are known to cause sting in the player's hands. As a further feature, with a separate taper portion 27 which may have a non-circular cross-section, such as the star-shaped cross-section as shown in FIG. 4B, whereby such star-shaped taper geometry or equivalent further dissipates or disrupts the transmission of vibrations to the handle portion 9.

Figure 6:
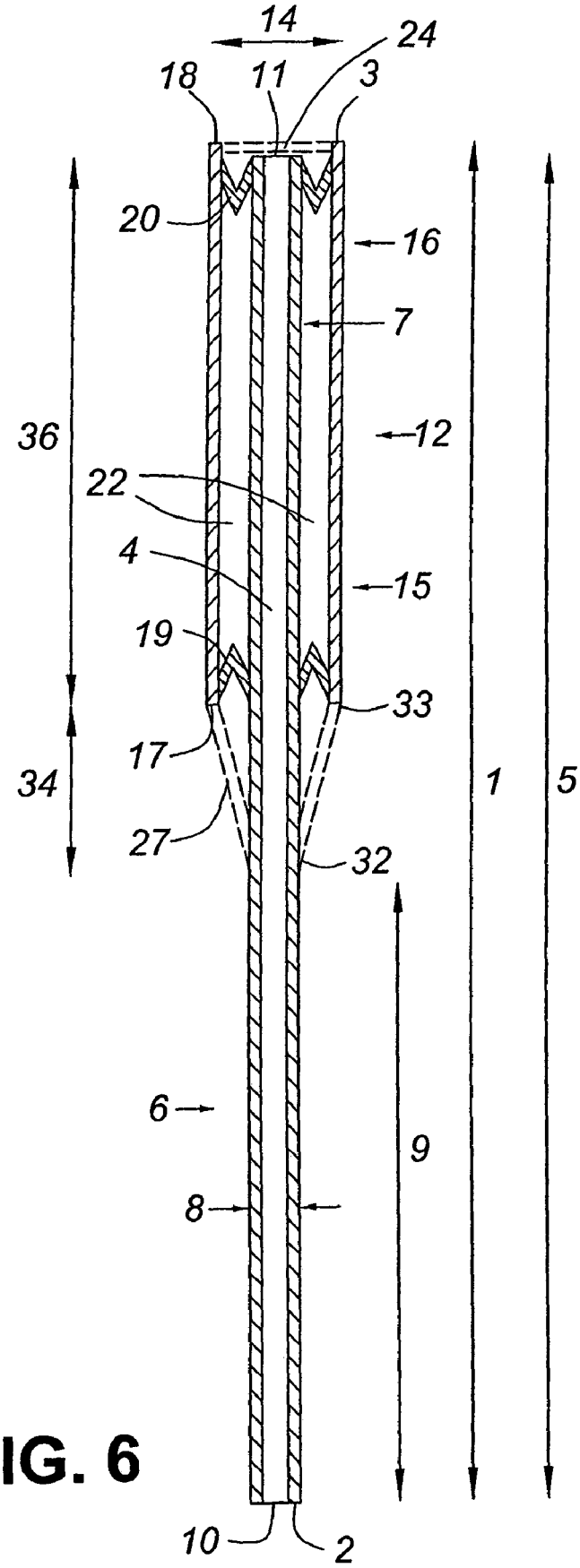
FIG. 6 is the bat of FIG. 5 showing both an optional separate additive taper section and/or an optional separate additive traditional endcap both in dotted outline. Not counting the traditional endcap and knob.
Figure 7:
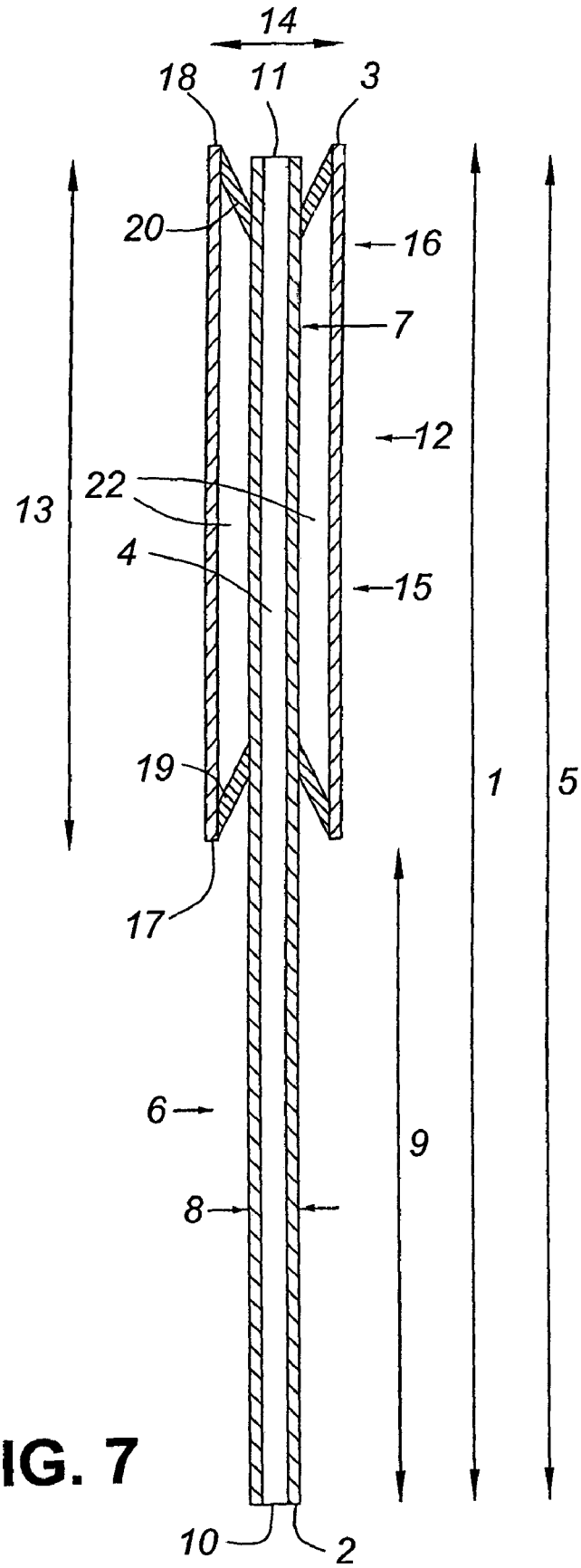
FIG. 7 depicts a variant of the bat of FIG. 5 showing alternative conical geometry flexible circumferential connecting structures.
Figure 8:
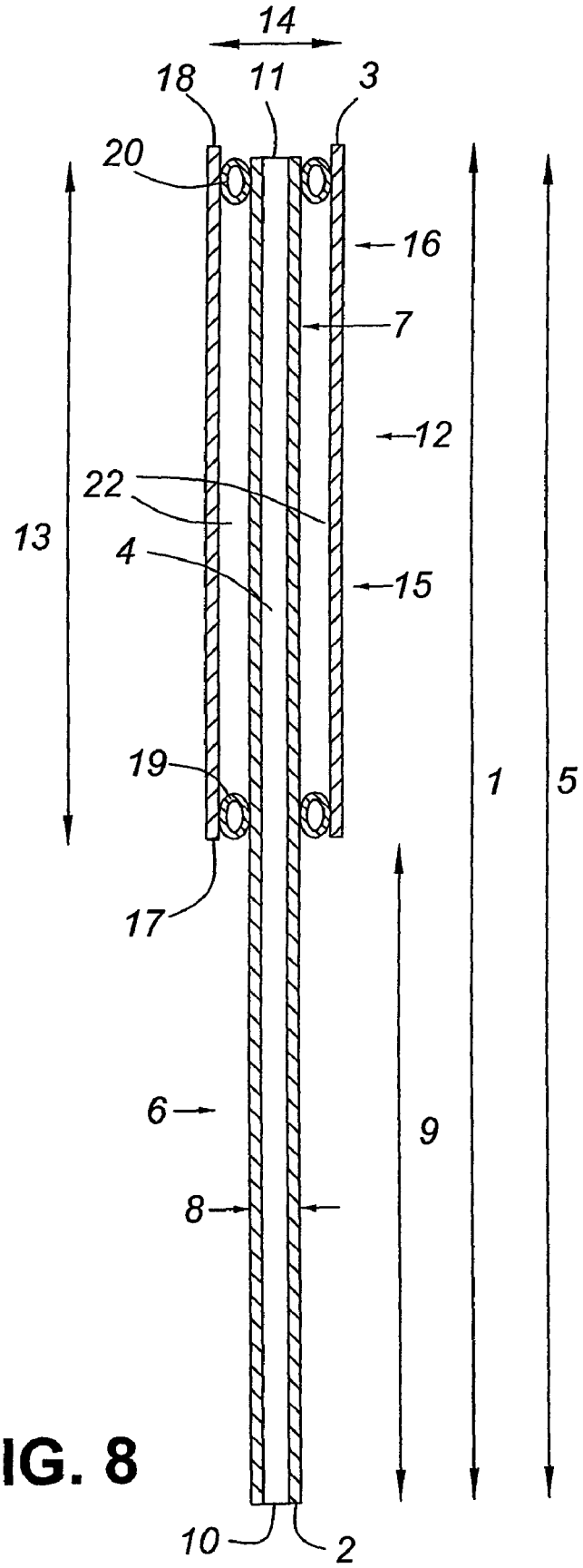
FIG. 8 depicts a further variant of the bat of FIG. 5 showing flexible circumferential connecting structures, with torus or "donut-shaped" cross sectional geometry.
Figure 8A:
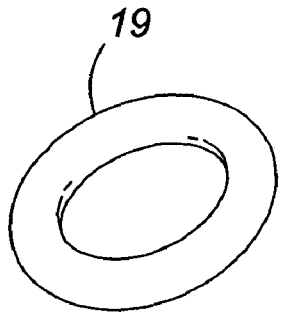
FIG. 8A depicts such a toroidal connecting structure in perspective.

Bat embodiments of the present invention may, as shown in FIG. 6, or may not, as shown in FIGS. 5, 7, 8, 9, 10, 11, 12 and 13 include a separate endcap 24 to enclose the barrel portion distal end 18; and may, or may not include a separate taper portion 27 as shown in FIG. 6 to enclose the barrel proximal end 17. Further, though not shown, all bat embodiments of the present invention include a traditional knob 40 at the shaft portion proximal end 10 to enclose bat proximal end 2 and to prevent the players hands from slipping off the bat when hitting. Besides the traditional endcap 24 or equivalent 21, and knob 40, FIG. 6 shows a taper 27, a core shaft 4, and a barrel 12 as three separate bat components.

The invention may be embodied in other specific forms without departing from the spirit or essential characteristics thereof. The present embodiments are therefore to be considered as illustrative and not restrictive, the scope of the invention being indicated by the appended claims rather than by the foregoing description, and all changes that come within the meaning and the range of equivalency of the claims are therefore intended to be embraced therein.

We claim:

1. A tubular bat, having an overall bat length, for hitting a ball, the bat comprising:

a) a core shaft having a core shaft length and including a handle portion for gripping the bat;

b) a tubular barrel for hitting a ball, the barrel having a proximal portion and a distal portion with respect to the handle portion, the barrel being connected to the core shaft;

c) at least a first elastically resilient connecting structure extending laterally from the core shaft for connecting the proximal portion of the barrel to the core shaft;

d) a separation gap disposed between the core shaft and the barrel for allowing the barrel to elastically deform when the barrel hits the ball, wherein the core shaft length extends to the distal portion of the barrel, and wherein the first connecting structure has a shape selected from the group consisting of toroidal.

2. A tubular bat, having an overall bat length, for hitting a ball, the bat comprising:

a) a core shaft having a core shaft length and including a handle portion for gripping the bat;

b) a tubular barrel for hitting a ball, the barrel having a proximal portion and a distal portion with respect to the handle portion, the barrel being connected to the core shaft; and c) a plurality of elastically resilient connecting structures disposed between the core shaft and the barrel and extending laterally from the core shaft for connecting the proximal portion of the barrel to the core shaft;

wherein the core shaft length extends to the distal portion of the barrel, wherein the connecting structures comprise a plurality of discrete, contiguous flexible airbags which extend substantially from the proximal end of the barrel portion to the distal end of the barrel portion.

3. A bat as in claim 1 comprising a second elastically resilient connecting structure which extends between the core shaft and the barrel proximate to its distal end, and wherein the second connecting structure is a member having a shape selected from the group consisting of toroidal.

4. A bat as in any one of claims 1, 2, or 3 comprising an intermediate elastically resilient support structure extending laterally from the core shaft to the barrel at a location intermediate the proximal and distal portions of the barrel.

5. A tubular bat, having an overall bat length, for hitting a ball, the bat comprising:

a) a core shaft having a core shaft length and including a handle portion for gripping the bat;

b) a tubular barrel for hitting a ball, the barrel having a proximal portion and a distal portion with respect to the handle portion, the barrel being connected to the core shaft;

c) at least a first elastically resilient connecting structure disposed between the core shaft and the barrel and extending laterally from the core shaft for connecting the proximal portion of the barrel to the core shaft;

wherein the core shaft length extends to the distal portion of the barrel, and wherein the first connecting structure comprises a plurality of airbags, and wherein none of the airbags are laterally contained by the barrel or core shaft.

* * * * *